US008264509B2

(12) United States Patent
Inoue et al.

(10) Patent No.: US 8,264,509 B2
(45) Date of Patent: Sep. 11, 2012

(54) EXPOSURE HEAD, IMAGE FORMING APPARATUS, AND IMAGE FORMING METHOD

(75) Inventors: Nozomu Inoue, Matsumoto (JP); Yoshio Arai, Shiojiri (JP); Kiyoshi Tsujino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 317 days.

(21) Appl. No.: 12/694,097

(22) Filed: Jan. 26, 2010

(65) Prior Publication Data

US 2010/0225731 A1 Sep. 9, 2010

(30) Foreign Application Priority Data

Mar. 4, 2009 (JP) ..... 2009-050183

(51) Int. Cl.
*B41J 2/44* (2006.01)

(52) U.S. Cl. ..... 347/132; 347/237; 347/247

(58) Field of Classification Search ..... 347/132, 347/233, 237, 247
See application file for complete search history.

(56) References Cited

U.S. PATENT DOCUMENTS

| | | | | |
|---|---|---|---|---|
| 7,116,345 | B2 | 10/2006 | Gyoutoku et al. | 347/238 |
| 7,298,350 | B2 * | 11/2007 | Kitazawa et al. | 345/76 |
| 2004/0145645 | A1 | 7/2004 | Gyoutoku et al. | 347/238 |
| 2008/0030566 | A1 | 2/2008 | Nomura et al. | 347/130 |

FOREIGN PATENT DOCUMENTS

| | | |
|---|---|---|
| JP | 2004-195963 | 7/2004 |
| JP | 2008-036937 | 2/2008 |
| JP | 2008-036939 | 2/2008 |

* cited by examiner

*Primary Examiner* — Huan Tran
(74) *Attorney, Agent, or Firm* — DLA Piper LLP (US)

(57) ABSTRACT

An exposure head includes a light emitting segment that emits light; an electrical load that is electrically connected to a circuit in which a current to be supplied to the light emitting segment flows; and a current supply controller that supplies a first current to the light emitting segment to cause the light emitting segment to emit light and supplies a second current to the electrical load during the time when the current supply controller blocks the supply of the first current to the light emitting segment.

8 Claims, 9 Drawing Sheets

EXPOSURE HEAD, IMAGE FORMING APPARATUS, AND IMAGE FORMING METHOD

BACKGROUND

1. Technical Field

The present invention relates to an exposure head that exposes a surface of an object to light emitted by a light emitting segment, an image forming apparatus using the exposure head, and an image forming method using the exposure head.

2. Related Art

JP-A-2004-195963 describes an exposure head that exposes a surface such as a surface of a photosensitive drum to form a latent image on the surface. The exposure head has multiple light emitting segments. Light emitted by the light emitting segments is incident on the surface and forms spots on the surface. As a result, an image is formed on the surface. The surface is uniformly charged to a certain potential before the exposure by the exposure head. Portions of the surface, on which the spots are formed, are discharged by the exposure so that a desirable latent image is formed on the surface. Then, charged toner is deposited on the discharged portions so that the latent image is developed into a visible image.

As described in JP-A-2004-195963, organic electroluminescence elements may be used as the light emitting segments. This type of light emitting segment generates heat when the light emitting segment emits light. In addition, the intensity of light emitted by this type of light emitting segment may vary due to a variation in the temperature of the light emitting segment. Thus, this type of light emitting segment has the following problem.

The light emission state of each light emitting segment included in the exposure head depends on a latent image to be formed. Specifically, when a latent image is to be formed for a high-density image, the frequency of light emission by each light emitting segment is high. On the other hand, when a latent image is to be formed for a low-density image, the frequency of light emission by each light emitting segment is not high. It is assumed that a latent image to be formed includes both a portion for a high-density image and a portion for a low-density image. In this assumption, some of the light emitting segments frequently emit light to the portion for the high-density image and thereby have high temperatures. However, the other light emitting segments do not frequently emit light to the portion for the low-density image and thereby have relatively low temperatures. Thus, the light emission state of each light emitting segment depends on the latent image to be formed. As a result, the temperatures of the light emitting segments may vary. Due to a variation in the temperature of each light emitting segment, the intensity of light emitted by the light emitting segment varies. A difference between or differences among the temperatures of the light emitting segments leads to a difference between or differences among the intensities of light emitted by the light emitting segments. Therefore, a failure may occur in a formed image. Specifically, an unwanted difference between or differences among gray levels may occur in the formed image.

SUMMARY

An advantage of some aspects of the invention is to provide a technique for reducing a variation in the temperature of a light emitting segment regardless of the light emission state of the light emitting segment.

According to a first aspect of the invention, an exposure head includes: a light emitting segment that emits light; an electrical load that is electrically connected to a circuit in which a current to be supplied to the light emitting segment flows; and a current supply controller that supplies a first current to the light emitting segment to cause the light emitting segment to emit light and supplies a second current to the electrical load during the time when the current supply controller blocks the supply of the first current to the light emitting segment.

According to a second aspect of the invention, an image forming apparatus includes: a latent image carrier on which a latent image is formed; an exposure head having a light emitting segment that emits light, an electrical load that is electrically connected to a circuit in which a current to be supplied to the light emitting segment flows, and an optical system that focuses the light emitted by the light emitting segment onto the latent image carrier; and a current supply controller that supplies a first current to the light emitting segment to cause the light emitting segment to emit light and supplies a second current to the electrical load during the time when the current supply controller blocks the supply of the first current to the light emitting segment.

According to a third aspect of the invention, an image forming method includes the steps of: supplying a first current to a light emitting segment to cause the light emitting segment to emit light and exposing a latent carrier to the light emitted by the light emitting segment; and blocking the supply of the first current to the light emitting segment and supplying a second current to an electrical load that is electrically connected to a circuit in which the first current to be supplied to the light emitting segment flows.

In the invention, the first current is supplied to the light emitting segment to cause the light emitting segment to emit light, while the supply of the first current to the light emitting segment is blocked to prevent the light emitting segment from emitting light. When the light emitting segment emits light, the light emitting segment generates heat. To avoid the aforementioned problem caused by the heat generated by the light emitting segment, the second current is supplied to the electrical load when the light emitting segment is in a non-emitting state. The electrical load receives the second current and generates heat due to the received second current. As a result, the electrical load heats the light emitting segment that is in the non-emitting state. Thus, the electrical load is capable of reducing the difference between the temperature of the light emitting segment in a light emitting state and the temperature of the light emitting segment in the non-emitting state. In other words, the electrical load is capable of reducing a variation in the temperature of the light emitting segment regardless of the light emission state of the light emitting segment.

The current supply controller may continuously supply the second current to the electrical load during the time when the current supply controller blocks the supply of the first current to the light emitting segment. In this case, the light emitting segment is maintained at a high temperature during the time when the supply of the first current to the light emitting segment is blocked or when the light emitting segment is in the non-emitting state. The electrical load is therefore capable of further reducing the difference between the temperature of the light emitting segment in the light emitting state and the temperature of the light emitting segment in the non-emitting state.

The current supply controller may continuously block the supply of the second current to the electrical load during the time when the current supply controller supplies the first current to the light emitting segment. In this case, the light emitting segment in the light emitting state generates heat. The light emitting segment in the non-emitting state is heated by the electrical load. The electrical load is therefore capable of reducing the difference between the temperature of the light emitting segment in the light emitting state and the temperature of the light emitting segment in the non-emitting state.

In addition, the second current may have the same value as that of the first current. This configuration has an advantage in that the difference between the amount of heat generated by the light emitting segment having the first current supplied thereto and the amount of heat generated by the electrical load having the second current supplied thereto can be reduced. In addition, this configuration is suitable for reducing the difference between the temperature of the light emitting segment in the light emitting state and the temperature of the light emitting segment in the non-emitting state.

Furthermore, the light emitting segment and the electrical load may be organic electroluminescence elements. This structure is capable of easily reducing the difference between the amount of heat generated by the light emitting segment having the first current supplied thereto and the amount of heat generated by the electrical load having the second current supplied thereto. Thus, this structure is capable of simply and reliably reducing the difference between the temperature of the light emitting segment in the light emitting state and the temperature of the light emitting segment in the non-emitting state.

When the light emitting segment and the electrical load are the organic electroluminescence elements, both the light emitting segment and the electrical load emit light. The exposure head may have an optical system and a light shielding portion. The optical system focuses the light emitted by the light emitting segment. If the light emitted by the electrical load were incident on the optical system, an exposure failure would occur. That is, a portion of a surface that does not need to be exposed would be exposed to the light emitted by the electrical load. The light shielding portion prevents the light emitted by the electrical load from being incident on the optical system. Thus, the light shielding portion prevents such an exposure failure.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
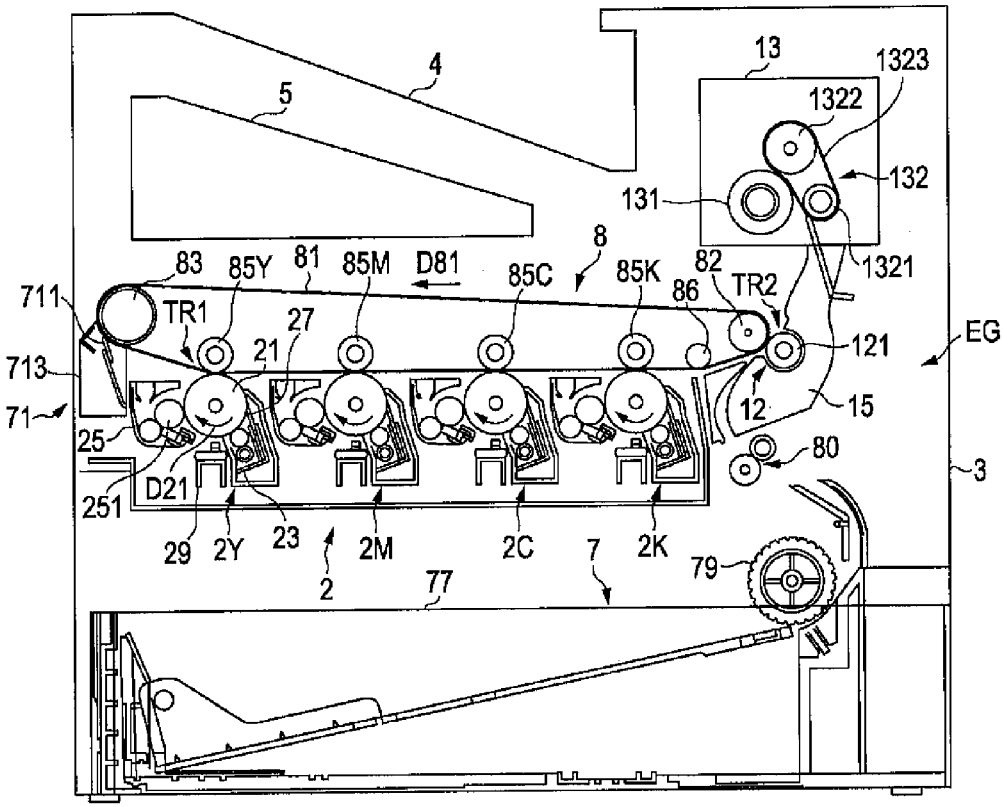
FIG. 1 is a diagram of an image forming apparatus according to a first embodiment of the invention.
Figure 2:
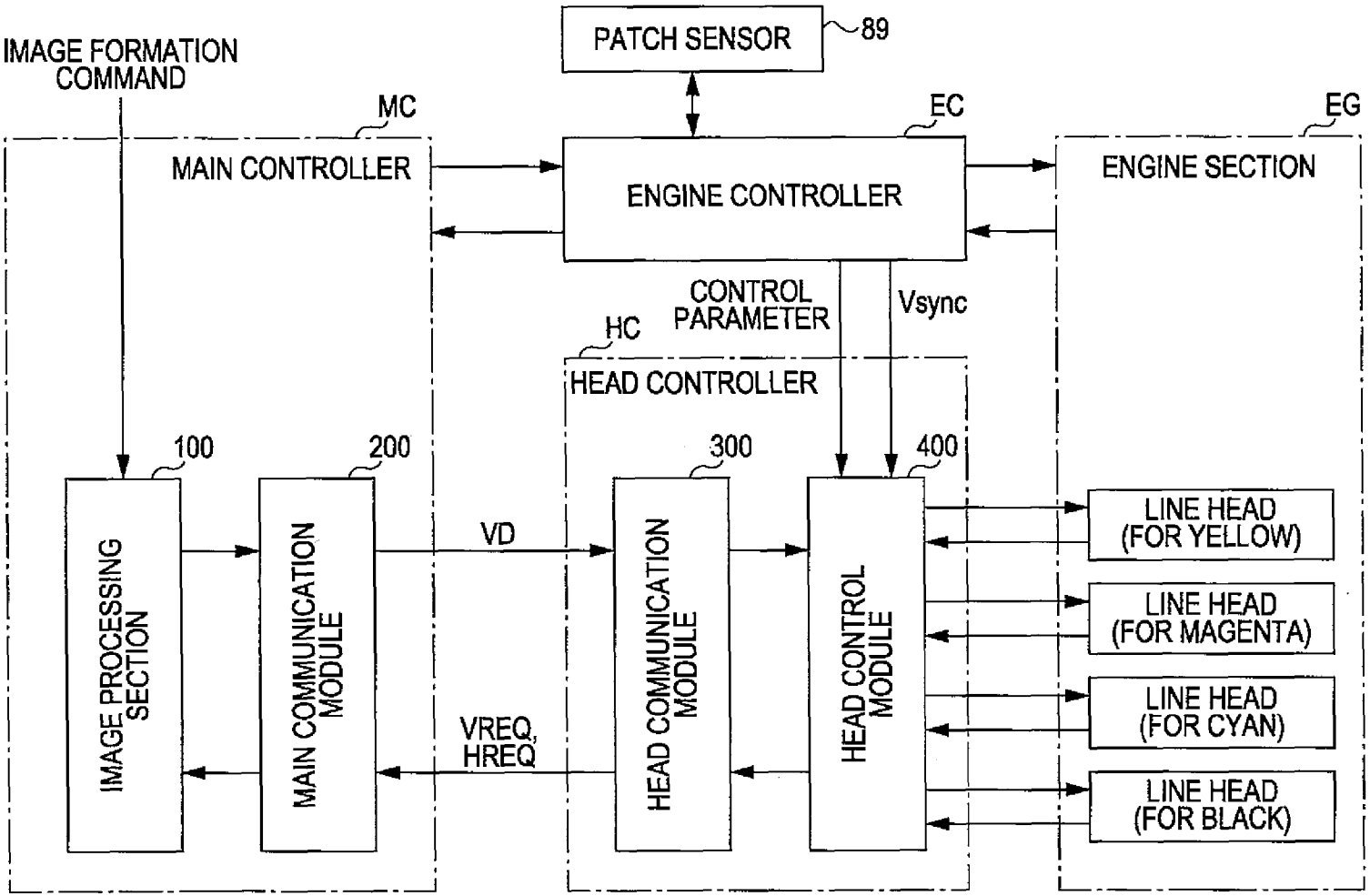
FIG. 2 is a diagram of an electrical configuration of the image forming apparatus shown in FIG. 1.

FIG. 1 shows an image forming apparatus according to the first embodiment of the invention. FIG. 2 shows an electrical configuration of the image forming apparatus shown in FIG. 1. The image forming apparatus has a color mode and a monochromatic mode. The image forming apparatus is capable of selectively performing the color mode and the monochromatic mode. In the color mode, the image forming apparatus forms a color image by superimposing toner images of four colors (yellow, magenta, cyan and black colors). In the monochromatic mode, the image forming apparatus uses only black toner to form a monochromatic image. The image forming apparatus has a main controller MC, an engine controller EC, an engine section EG and a head controller HC. The main controller MC includes a CPU and a memory. When the main controller MC receives an image formation command from an external device such as a host computer, the main controller MC transmits a control signal to the engine controller EC. The engine controller EC receives the control signal and controls the engine section EG, the head controller HC and the like of the image forming apparatus on the basis of the received control signal to cause the image forming apparatus to perform a predetermined image forming operation. Then, the image forming apparatus performs the predetermined image forming operation to form an image on a printing sheet (such as a copy paper, a transfer paper, a normal paper, or an OHP transparent sheet) according to the image formation command.

The image forming apparatus according to the present embodiment has a housing body 3 and an electrical component box 5. The electrical component box 5 is contained in the housing body 3. The electrical component box 5 contains a power supply circuit substrate, the main controller MC, the engine controller EC, and the head controller HC. The housing body 3 also contains an image forming unit 2, a transfer belt unit 8, and a sheet feeding unit 7. The housing body 3 further contains a secondary transfer unit 12, a fixing unit 13 and a sheet guide member 15, which are located on the right side of FIG. 1. The sheet feeding unit 7 is removable from and attachable to the housing body 3. The sheet feeding unit 7 and the transfer belt unit 8 can be removed from the housing body 3 and repaired or replaced with other units.

The image forming unit 2 has four image forming stations 2Y (for yellow), 2M (for magenta), 2C (for cyan) and 2K (for black), which form images of different colors from each other. The image forming stations 2Y, 2M, 2C and 2K have the same configuration. Thus, some reference numerals are shown only for the image forming station 2Y for convenience of illustration. The reference numerals are not shown for the other image forming stations.

The image forming stations 2Y, 2M, 2C and 2K include respective photosensitive drums 21. The image forming station 2Y forms a yellow toner image on a surface of the photosensitive drum 21 included in the image forming station 2Y. The image forming station 2M forms a magenta toner image on a surface of the photosensitive drum 21 included in the image forming station 2M. The image forming station 2C forms a cyan toner image on a surface of the photosensitive image 21 included in the image forming station 2C. The image forming station 2K forms a black toner image on a surface of the photosensitive image 21 included in the image forming station 2K. Each photosensitive drum 21 has a rotational axis parallel to or substantially parallel to a main scanning direction MD (perpendicular to the surface of the paper sheet of FIG. 1). The photosensitive drums 21 are connected to respective dedicated drive motors. Each photosensitive drum 21 is driven to rotate at a predetermined rotation rate in a rotational direction D21 (shown by an arrow) by the dedicated drive motor. The surface of each photosensitive drum 21 moves in the rotational direction D21. Each of the image forming stations 2Y, 2M, 2C and 2K includes a charger 23, a line head 29, a developer 25 and a photosensitive drum cleaner 27, which are located at the periphery of the photosensitive drum 21 included in the image forming station and are arranged along the surface of the photosensitive drum 21. The charger 23 included in each image forming station charges the surface of the photosensitive drum 21 included in the image forming station. The line head 29 included in each image forming station forms a latent image on the surface of the photosensitive drum 21 included in the image forming station. The developer 25 included in each image forming station develops, into a toner image, the latent image formed on the surface of the photosensitive drum 21 included in the image forming station. In the color mode, the image forming apparatus superimposes the toner images formed by the image forming stations 2Y, 2M, 2C and 2K onto a transfer belt 81 to form a color image. The transfer belt 81 is included in the transfer belt unit 8. In the monochromatic mode, the image forming apparatus operates the image forming station 2K to form a black image (monochromatic image).

Each charger 23 includes a charging roller having a surface made of elastic rubber. The charging roller included in each image forming station comes in contact with the surface of the photosensitive drum 21 included in the image forming station and is rotated by the rotation of the photosensitive drum 21. Each charging roller is connected to a charging bias generator (not shown). The charging bias generator supplies a charging bias to each charging roller. Then, the charging roller included in each image forming station receives, the charging bias and charges the surface of the photosensitive drum 21 included in the image forming station to a predetermined surface potential at the contact point of the charging roller and the photosensitive drum 21.

Each line head 29 is arranged to ensure that a longitudinal direction LGD (shown in FIG. 3) of the line head 29 is parallel to or substantially parallel to the main scanning direction MD and that a lateral direction LTD (shown in FIG. 3) of the line head 29 is parallel to or substantially parallel to an auxiliary scanning direction SD. The auxiliary scanning direction SD is perpendicular to or substantially perpendicular to the main scanning direction MD. Each line head 29 has a plurality of light emitting segments E that are arranged in two rows in the longitudinal direction LGD. The line head 29 included in each image forming station is arranged opposite the photosensitive drum 21 included in the image forming station. The light emitting segments E included in each image forming station emit light to the surface of the photosensitive drum 21 charged by the charger 23 included in the image forming station to form an electrostatic latent image on the surface of the photosensitive drum 21.

Figure 3:
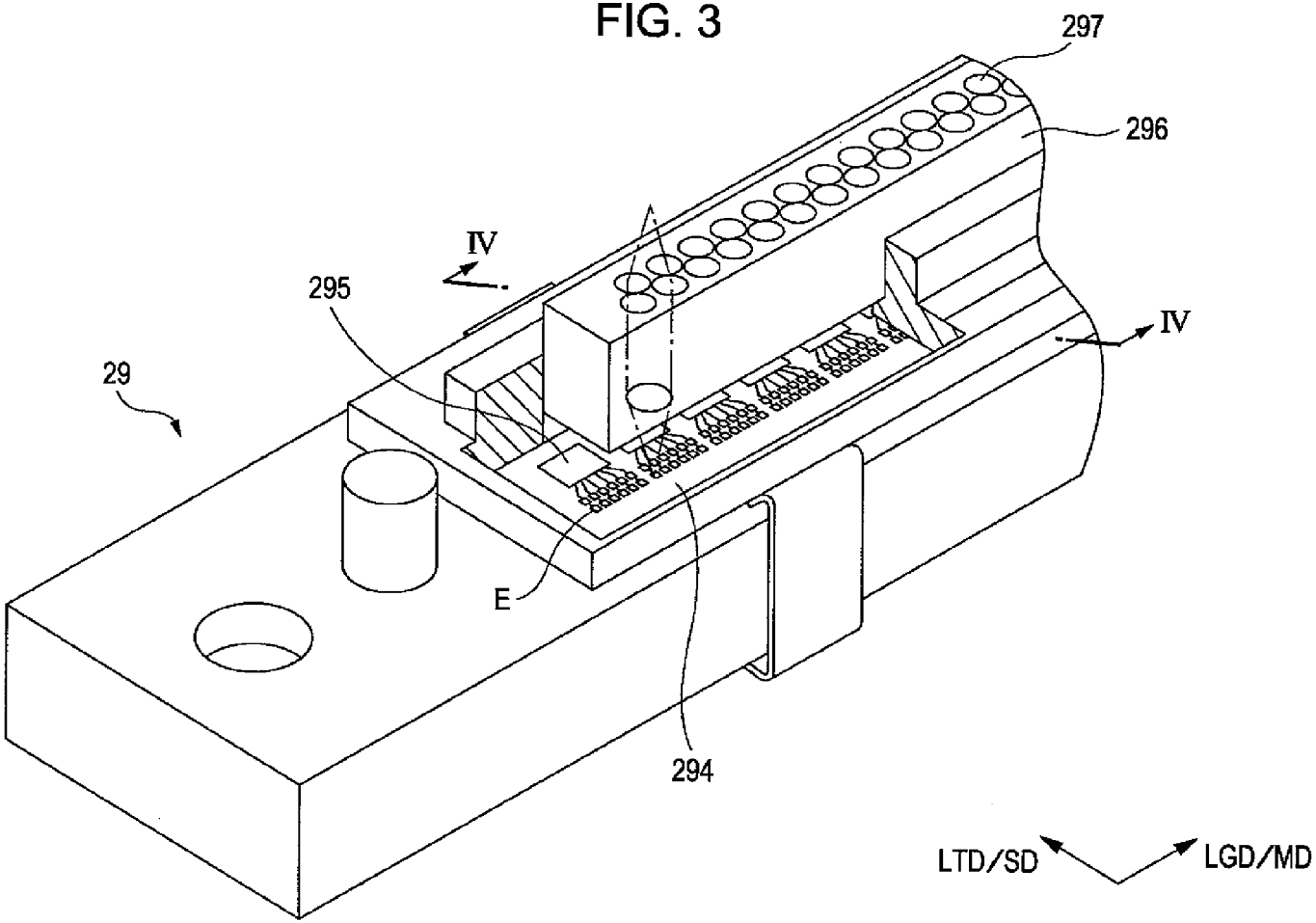
FIG. 3 is a perspective view of a line head.
Figure 4:
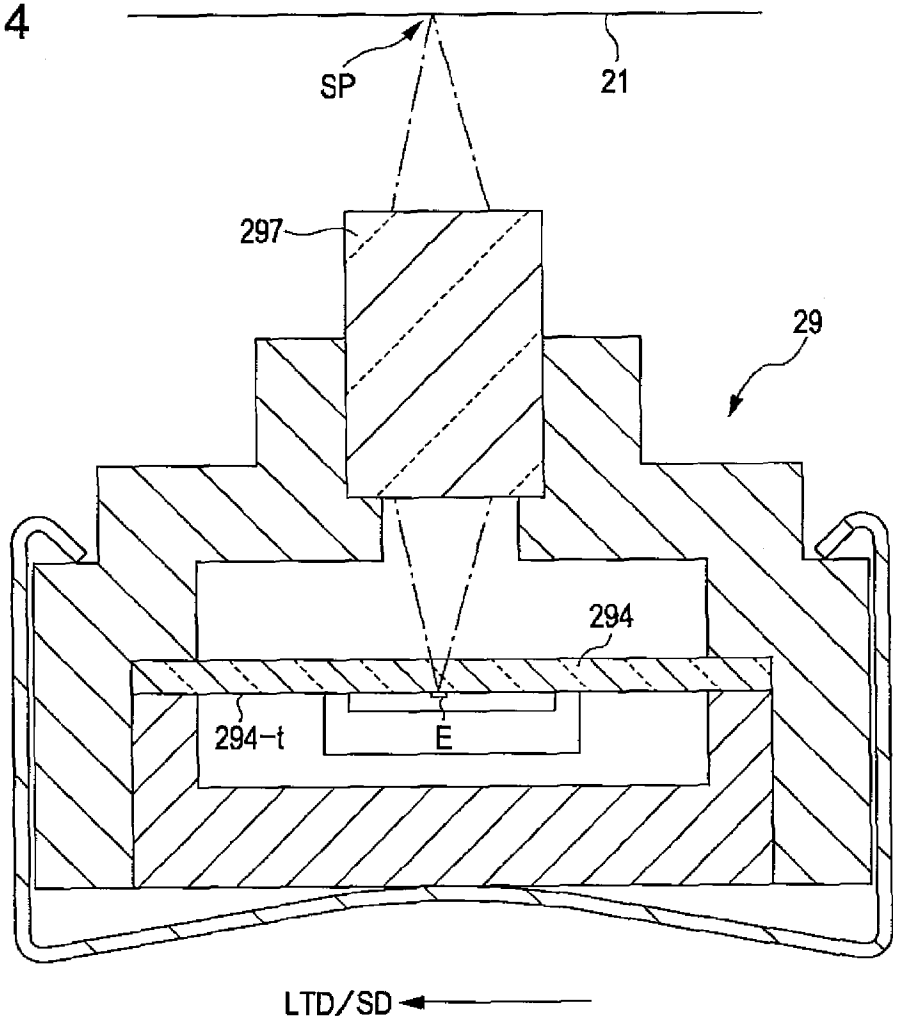
FIG. 4 is a partial cross sectional view of the line head taken along a line IV-IV shown in FIG. 3.

FIG. 3 is a perspective view of a structure of one of the line heads 29. Each line head 29 has a head substrate 294. FIG. 3 illustrates a back surface of one of the head substrates 294, and does not illustrate a front surface of the head substrate 294. The front surface of the head substrate 294 is located on the upper side of FIG. 3, while the back surface of the head substrate 294 is located on the lower side of FIG. 3. FIG. 4 is a partial cross sectional view of a structure of one of the line heads 29. The line head 29 shown in FIG. 4 is taken along a line IV-IV shown in FIG. 3. Each head substrate 294 is made of glass. The plurality of light emitting segments E included in each line head 29 are arranged in two rows in the main scanning direction MD (longitudinal direction LGD) and in a staggered staggered pattern and are mounted on the back surface 294-*t* of the head substrate 294 included in the line head 29. Each of the light emitting segments E is a bottom emission type organic electroluminescence element. Each line head 29 has at least one light emission drive module 295 (not shown in FIG. 4) mounted on the back surface 294-*t* of the head substrate 294. The light emission drive module 295 included in each line head 29 supplies a drive current to each of the light emitting segments E included in the line head 29. Each light emission drive module 295 includes low-temperature polysilicon thin film transistors. When the light emission drive module 295 included in each line head 29 supplies the drive current to each light emitting segment E included in the line head 29, the light emitting segment E emits an optical beam from its light emitting surface.

Each line head 29 also includes a refractive index distribution type rod lens array 297. The optical beams emitted by the light emitting segments E included in each image forming station pass through the head substrate 294 included in the image forming station and are incident on the refractive index distribution type rod lens array 297 included in the image forming station. Then, portions of the surface of the photosensitive drum 21 included in each image forming station are exposed to the optical beams emitted by the light emitting segments E. The optical beams emitted by the light emitting segments E included in each image forming station form spots SP on the surface of the photosensitive drum 21. In other words, the optical beams emitted by the light emitting segments E are focused by the refractive index distribution type rod lens array 297 included in the image forming station onto the surface of the photosensitive drum 21 included in the image forming station. In this way, an erected and equal-magnification image is formed on each photosensitive drum 21. The portions of the surface of each photosensitive drum 21, on which the spots SP are formed, are discharged by the exposure. Therefore, the line head 29 included in each image forming station forms an electrostatic latent image on the surface of the photosensitive drum 21 included in the image forming station.

Returning back to FIG. 1, each developer 25 has a developing roller 251. Each developing roller 251 has toner on its surface and is electrically connected to a developing bias generator (not shown). The developing bias generator applies a developing bias to each developing roller 251. When the developing roller 251 included in each image forming station receives the developing bias, charged toner moves from the developing roller 251 to the photosensitive drum 21 included in the image forming station through a contact point of the developing roller 251 and the photosensitive drum 21. The electrostatic latent image formed on the surface of each photosensitive drum 21 is visualized by the toner.

Each photosensitive drum 21 transports the visualized toner image in the rotational direction D21 of the photosensitive drum 21. The visualized toner image formed on each photosensitive drum 21 is primarily transferred to the transfer belt 81 at a contact point TR1 of the transfer belt 81 and the photosensitive drum 21.

The photosensitive drum cleaner 27 included in each image forming station is arranged so that the surface of the photosensitive drum 21 included in the image forming station moves from the contact point TR1 through the photosensitive drum cleaner 27 to the charger 23 included in the image forming station. The photosensitive drum cleaner 27 included in each image forming station is in contact with the surface of the photosensitive drum 21 included in the image forming station. The photosensitive drum cleaner 27 included in each image forming station removes toner from the surface of the photosensitive drum 21 included in the image forming station after the primary transfer.

The transfer belt unit 8 includes a drive roller 82, a driven roller (blade opposing roller) 83 and the transfer belt 81. The driven roller 83 is located on the left side of the drive roller 82 in FIG. 1. The transfer belt 81 is stretched between the rollers 82 and 83. The transfer belt 81 is driven by rotation of the drive roller 82 to move in a direction (transport direction) D81 shown by an arrow (shown in FIG. 1). The transfer belt unit 8 also has four primary transfer rollers 85Y, 85M, 85C and 85K. The four primary transfer rollers 85Y, 85M, 85C and 85K are located on an inner side of the transfer belt 81. The primary transfer rollers 85Y, 85M, 85C and 85K are arranged opposite the respective photosensitive drums 21 included in the image forming stations 2Y, 2M, 2C and 2K under the condition that cartridges (described later) are set. The primary transfer rollers 85Y, 85M, 85C and 85K are electrically connected to respective primary transfer bias generators (not shown).

In the color mode, the primary transfer rollers 85Y, 85M, 85C and 85K are positioned on the respective sides of the image forming stations 2Y, 2M, 2C and 2K so as to press the transfer belt 81 and allow the transfer belt 81 to be in contact with the respective photosensitive drums 21 included in the image forming stations 2Y, 2M, 2C and 2K at the respective contact points TR1, as shown in FIG. 1. Then, the primary transfer bias generators apply primary transfer biases to the respective primary transfer rollers 85Y, 85M, 85C and 85K at appropriate times to ensure that the toner images formed on the respective surfaces of the photosensitive drums 21 are transferred to an outer surface of the transfer belt 81 at the respective contact points TR1. In the color mode, the image forming apparatus superimposes the monochromatic toner images of yellow, magenta, cyan and black colors onto the transfer belt 81 to form a color image.

The transfer belt unit 8 also has a downstream guide roller 86. The downstream guide roller 86 is arranged so that the surface of the transfer belt 81 moves from the. primary transfer roller 85K (for black) through the downstream guide roller 86 to the drive roller 82. The downstream guide roller 86 is in contact with the transfer belt 81 on a tangent of the primary transfer roller 85K. The tangent of the primary transfer roller 85K is drawn from the contact point TR1 of the transfer belt 81 and the photosensitive drum 21 included in the image forming station 2K.

The image forming apparatus also has a patch sensor 89. The patch sensor 89 has a surface that faces the outer surface of the transfer belt 81 at the contact point of the transfer belt 81 and the downstream guide roller 86. The patch sensor 89 may be a reflective photosensor. The patch sensor 89 optically detects a variation in reflectance of the outer surface of the transfer belt 81 to detect the position of a patch image formed on the transfer belt 81 and the density of the patch image.

The sheet feeding unit 7 has a sheet feeding section. The sheet feeding section has a sheet feeding cassette 77 and a pickup roller 79. The sheet feeding cassette 77 is capable of holding stacked sheets. The pickup roller 79 feeds the stacked sheets one by one from the sheet feeding cassette 77. The image forming apparatus also has a pair of resist rollers 80, a secondary transfer roller 121, and a sheet guiding member 15. After each sheet output from the sheet feeding cassette 77 by the pickup roller 79 reaches the pair of resist rollers 80, the pair of resist rollers 80 adjusts the timing for feeding the sheet. After the adjustment of the timing for feeding each sheet, the sheet moves along the sheet guiding member 15 and reaches a contact point TR2 of the drive roller 82 and the secondarily transfer roller 121. Then, the image formed on the transfer belt 81 is secondarily transferred to the sheet at the contact point TR2.

The secondary transfer roller 121 is driven by a secondary transfer roller mechanism (not shown) to contact the transfer belt 81 and move away from the transfer belt 81. The fixing unit 13 has a heating roller 131 and a pressing section 132. The heating roller 131 has a heating element (such as a halogen heater) therein and is rotatable. The pressing section 132 presses and urges the heating roller 131. The pressing section 132 has a pressure belt 1323. The heating roller 131 and the pressure belt 1323 form a nip portion. Each sheet having the secondarily transferred image on its surface is guided to the nip portion by the sheet guide member 15. The secondarily transferred image is thermally fixed at a predetermined temperature by the nip portion. The pressing section 132 includes two rollers 1321, 1322 and the pressure belt 1323. The pressure belt 1323 is stretched between the two rollers 1321 and 1322. The surface of the pressure belt 1323 stretched by the two rollers 1321 and 1322 is pressed against a circular surface of the heating roller 131 so that the nip portion is large. Each sheet subjected to the fixing process is fed to a paper receiving tray 4 that is installed in an upper surface portion of the housing body 3.

The drive roller 82 drives the transfer belt 81 to cause the transfer belt 81 to move in the direction D81. The drive roller 82 serves as a backup roller for the secondary transfer roller 121. The drive roller 82 has a rubber layer on its circular surface. The rubber layer has a thickness of approximately 3 mm and a volume resistivity of 1000 KΩ·cm or less. The rubber layer is grounded through a metal shaft to serve as a conductive path for a secondary transfer bias. The secondary transfer bias is supplied from a secondary transfer bias generator (not shown) through the secondary transfer roller 121 to the drive roller 82. The rubber layer has a high frictional property and a high shock absorption property. Thus, the rubber layer prevents the quality of the image formed on the transfer belt 81 from being degraded due to transfer of a shock (that occurs when the sheet reaches the contact point TR2) to the transfer belt 81.

The image forming apparatus has a cleaner 71 arranged opposite the blade opposing roller 83. The cleaner 71 has a cleaner blade 711 and a toner disposal box 713. The cleaner blade 711 has an edge portion that indirectly contacts the blade opposing roller 83 through the transfer belt 81. The edge portion of the cleaner blade 711 removes toner, paper powder, foreign material and the like (that remain on the transfer belt 81 after the secondary transfer) from the transfer belt 81 by indirectly contacting the blade opposing roller 83 through the transfer belt 81. The removed foreign material and the like are collected in the toner disposal box 713. The cleaner blade 711, the toner disposal box 713 and the blade opposing roller 83 form an integrated unit.

In the present embodiment, the photosensitive drum 21, the charger 23, the developer 25 and the photosensitive drum cleaner 27, which are included in each of the image forming stations 2Y, 2M, 2C and 2K, form one of the aforementioned cartridges. The four cartridges are removable from and attachable to the image forming apparatus. Each cartridge is an integrated unit and has a nonvolatile memory that stores information on the cartridge. Each cartridge wirelessly communicates with the engine controller EC. The wireless communication allows each cartridge to transmit the information on the cartridge to the engine controller EC, and allows information stored in the memory of each cartridge to be updated. Each cartridge stores the updated information in the memory of the cartridge. In addition, the wireless communication allows use history of each cartridge and life expectancies of consumable supplies to be managed on the basis of the information on each cartridge.

In the present embodiment, the main controller MC and the head controller HC are provided in respective blocks. The line heads 29 are provided in a block different from the two blocks. The three blocks are connected to each other through serial communication lines. The following describes data communication among the three blocks with reference to FIG. 2. When the main controller MC receives the image formation command from the external device, the main controller MC transmits the control signal to the engine controller EC, as described above. The engine controller EC receives the control signal and then activates the engine section EG in response to the received control signal. The main controller MC has an image processing section 100. The image processing section 100 performs predetermined signal processing on image data included in the image formation command and generates video data for each toner color.

Specifically, when the engine controller EC receives the control signal, the engine controller EC initializes each part of the engine section EG and causes each part of the engine section EG to start warming up. When the engine section EG is ready to perform an image formation operation after completion of the initialization and the warming-up, the engine controller EC outputs a synchronization signal Vsync to the head controller HC that controls each of the line heads 29. The synchronization signal Vsync triggers the start of the image formation operation.

The head controller HC includes a head control module 400 and a head communication module 300. The head control module 400 controls each line head 29. The head communication module 300 performs data communication with the main controller MC. The main controller MC has a main communication module 200. The head communication module 300 transmits a vertical request signal VREQ to the main communication module 200. The vertical request signal VREQ indicates the head of an image for one page. In addition, the head communication module 300 transmits, to the main communication module 200, a horizontal request signal HREQ requesting video data for one of lines forming the image. The main communication module 200 transmits the requested video data to the head communication module 300 in response to the request signals. Specifically, after the main communication module 200 receives the vertical request signal VREQ, the main communication module 200 receives the horizontal request signal HREQ. Every time main communication module 200 receives the horizontal request signal HREQ, the main communication module 200 successively outputs video data VD for one image line from the head of the image. The head control module 400 controls the light emission drive module 295 included in each line head 29 on the basis of the received video data VD to cause the light emitting segments E included in each line head 29 to emit light. In this way, an electrostatic latent image is formed on the surface of each photosensitive drum 21 on the basis of the video data VD.

At least one of the light emitting segments E, which is located in a specified region, may continuously emit light depending on a pattern of the video data VD. The organic electroluminescence elements used as the light emitting segments E are different from inorganic light emitting diodes (e.g., compound semiconductors such as gallium arsenide). When the temperatures of the organic electroluminescence elements are increased, the intensities of light emitted by the organic electroluminescence elements are increased. When the increase in the temperature of any of the organic electroluminescence elements is 1° C., the intensity of light emitted by the organic electroluminescence element may vary largely and sometimes the variation of intensity may be approximately 0.5% at a normal temperature. Thus, as the number of sheets on which images are to be printed is increased, the temperature of the light emitting segment E that continuously emits light is increased. This results in a difference between the temperature of the light emitting segment E that continuously emits light and the temperature of the light emitting segment E that does not continuously emit light. This temperature difference may lead to a difference between the intensity of light continuously emitted by the light emitting segment E and the intensity of light intermittently emitted by the light emitting segment E.

Figure 5:
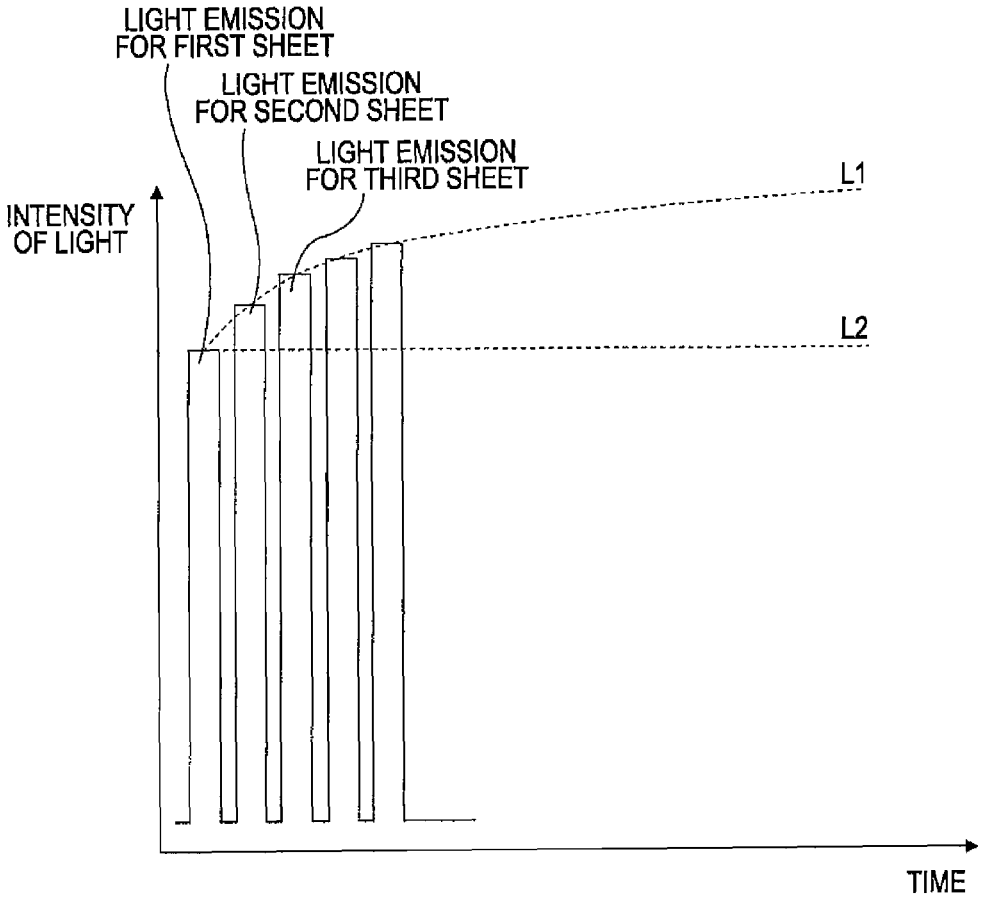
FIG. 5 is a graph showing a variation in the intensity of light continuously emitted by a light emitting segment, and a variation in the intensity of light intermittently emitted by the light emitting segment.

FIG. 5 is a graph showing a variation in the intensity of light continuously emitted by the light emitting segment E, and a variation in the intensity of light intermittently emitted by the light emitting segment E. In FIG. 5, a broken line L1 indicates the variation in the intensity of the light continuously emitted by the light emitting segment E, and a broken line L2 indicates the variation in the intensity of the light intermittently emitted by the light emitting segment E. The width of each bar illustrated in the graph of FIG. 5, which is measured in the direction of the abscissa axis of the graph, indicates a period of time when the light emitting segment E emits light in order to print an image on each sheet (i.e., indicates a period of time when the light emitting segment E emits light in order to print an image on the first sheet, a period of time when the light emitting segment E emits light in order to print an image the second sheet, etc.). The height of each bar, which is measured in the direction of the ordinate axis of the graph, indicates the intensity of the light continuously emitted by the light emitting segment E. As shown in FIG. 5, the light emitting segment E does not emit light during a period of time between the termination of each light emission and the start of the next light emission, for example, during a period of time between the termination of the first light emission and the start of the second light emission. However, the intensity of the light continuously emitted by the light emitting segment E is increased as the number of the light emissions is increased. The intensity of the light continuously emitted by the light emitting segment E is increased due to heat generated by the light emitting segment E. The amount of the generated heat depends on the number of light emitting segments E that are located adjacent to the light emitting segment E and simultaneously emit light. For example, even when a single light emitting segment E continuously emits light, heat generated by the single light emitting segment E is rapidly released to the ambient environment of the light emitting segment E, and an increase in the intensity of the light emitted by the light emitting segment E is small. On the other hand, when several tens to several hundreds of adjacent light emitting segments E continuously emit light, heat generated by the light emitting segments E is concentrated into an area in which the adjacent light emitting segments E are arranged. In this case, therefore, an increase in the intensity of the light emitted by each of the adjacent light emitting segments E is large. The intensity of the light emitted by the light emitting segment E under such a condition is increased (refer to the broken line L1 of FIG. 5). On the other hand, the variation in the intensity of the light intermittently emitted by the light emitting segment E is small (refer to the broken line L2 of FIG. 5).

It is assumed that after the printing operations are continuously performed under the aforementioned condition, the printing operation is performed in order to form a half-tone image with a uniform image density on the entire surface of a sheet. In this assumption, adjacent light emitting segments E that simultaneously emitted light in the previous printing operations emit light having high intensities in the last printing operation. As a result, image portions printed on sheet regions exposed by the adjacent light emitting segments E have higher image densities than those of the other image portion printed on the sheet. That is, the half-tone image is adversely impacted by the previously performed printing operations and does not have a uniform image density. Roughly speaking, each light emitting segment E can be cooled only in accordance with a time constant that is the same as or similar to a time constant for an increase in the temperature of the light emitting segment E. Thus, the aforementioned adverse impact due to the previous printing operations cannot be easily eliminated. It has been desired to provide a technique for reducing differences among the temperatures of the light emitting segments E. To reduce the differences, each line head 29 according to the present embodiment has the following configuration.

Figure 6:
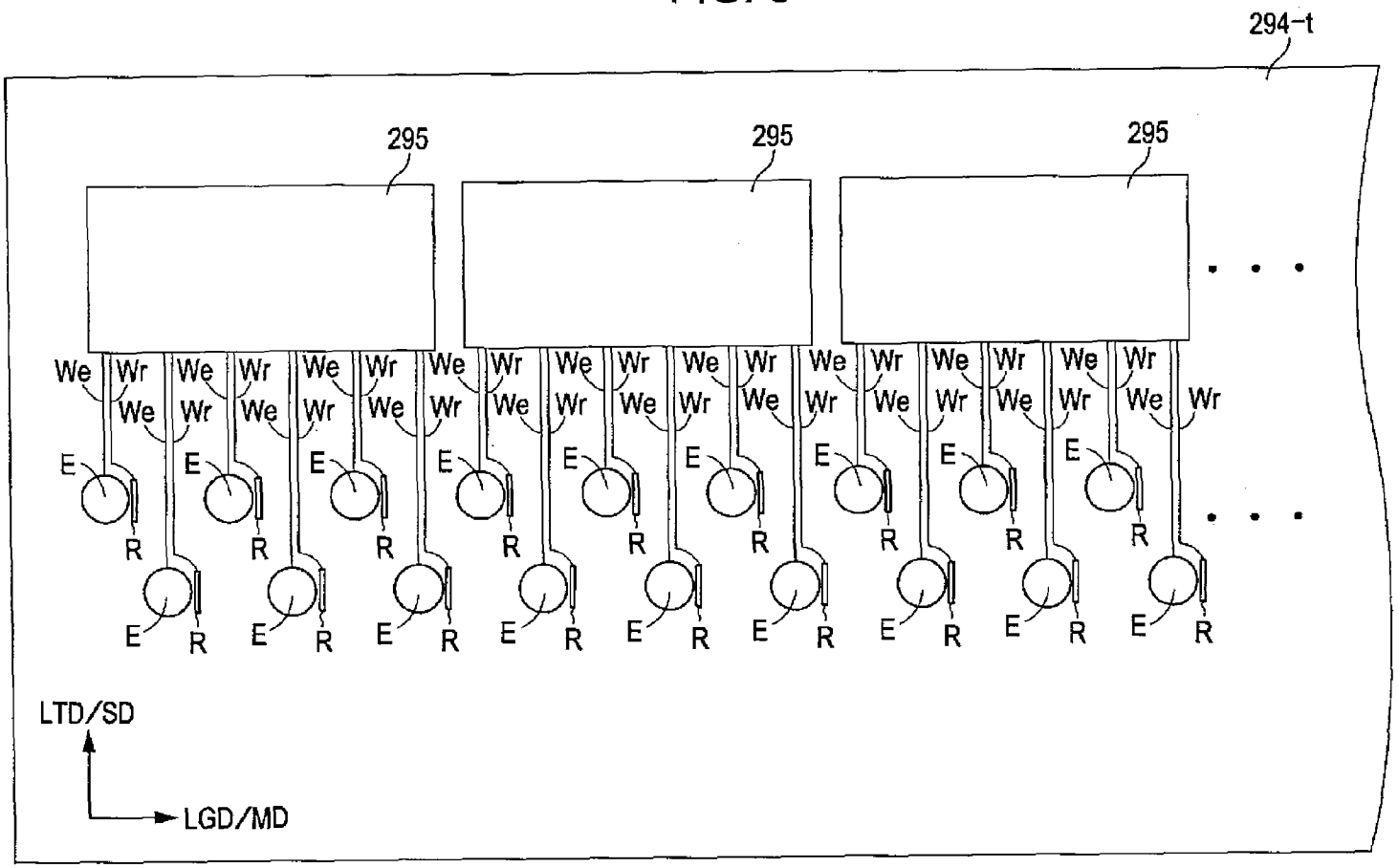
FIG. 6 is a plan view of a back surface of a head substrate according to the first embodiment.

FIG. 6 is a plan view of the back surface 294-*t* of one of the head substrates 294. In FIG. 6, the back surface 294-*t* of the head substrate 294 is viewed from the side of the front surface of the head substrate 294. As shown in FIG. 6, the light emitting segments E included in each line head 29 are arranged on the back surface 294-*t* of the head substrate 294 included in the line head 29. In addition, the light emitting segments E included in each line head 29 are arranged in the two rows in the main scanning direction MD (longitudinal direction LGD) and in the staggered pattern. Each light emission drive module 295 is provided for six adjacent light emitting segments E. The light emission drive module 295 included in each line head 29 is provided on the back surface 294-*t* of the head substrate 294 included in the line head 29. Each light emission drive module 295 is connected to the six adjacent light emitting segments E through lines We. Each light emitting segment E receives a drive current Ie (refer to FIG. 7) through the line We from the light emission drive module 295 and then emits light.

Each line head 29 includes electrical resistors R that are located adjacent to the respective light emitting segments E. Each electrical resistor R has a rectangular shape and has longer sides extending in the auxiliary scanning direction SD (lateral direction LTD). Each electrical resistor R has a load characteristic equivalent to or substantially equivalent to that of each light emitting segment E. The electrical resistors R included in each line head 29 have ends connected through lines Wr to the light emission drive module 295 included in the line head 29. Each electrical resistor R has another end connected to a ground potential. Each electrical resistor R receives a heater current Ih from the light emission drive module 295 through the line Wr and generates heat due to the received heater current Ih.

Figure 7:
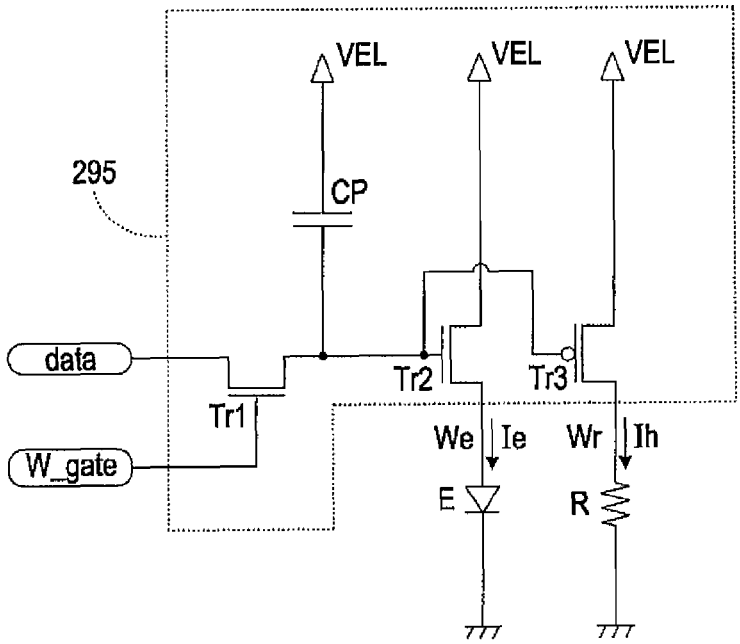
FIG. 7 is a diagram of the configuration of a circuit included in a light emission drive module according to the first embodiment.

FIG. 7 shows a circuit configuration of one of the light emission modules 295 according to the present embodiment. As described with reference to FIG. 6, each light emission drive module 295 according to the present embodiment is provided for the six light emitting segments E. Thus, each light emission drive module 295 has six drive circuits and six heating circuits. The six drive circuits included in each light emission drive module 295 drive the respective six light emitting segments E connected to the light emission drive module 295. The six heating circuits included in each light emission drive module 295 cause the respective six electrical resistors R connected to the light emission drive module 295 to generate heat. For convenience, FIG. 7 shows only one light emitting segment E, one electrical resistor R, one drive circuit connected to the light emitting segment E, and one heating circuit connected to the electrical resistor R. As shown in FIG. 7, the drive circuit and the heating circuit are included in each light emission drive module 295.

Each light emission drive module 295 has a data terminal (indicated by "data" in FIG. 7) and a capacitor CP, which are provided for each light emitting segment E. The data terminals are connected to the respective capacitors CP. Each data terminal receives a signal formed on the basis of the video data VD. The signal received by each data terminal is stored into the capacitor CP connected to the data terminal. Each light emission drive module 295 also has a gate terminal W_gate for each light emitting segment E. The gate terminal W_gate for each light emitting segment E controls timing for storing the signal received by the data terminal for the light emitting segment E into the capacitor CP for the light emitting segment E. In other words, the gate terminal W_gate determines whether or not the signal is stored into the capacitor CP. Thus, each gate terminal W_gate allows the signal received by the data terminal (connected to the gate terminal W_gate) to be stored into the capacitor CP (connected to the gate terminal W_gate) by means of a so-called time division driving technique.

Even when organic electroluminescence elements are not used as the light emitting segments E, a light intensity correction needs to be performed so that the light emitting segments E emit light having the same intensity (or so that the light emitting segments E have the same light emitting power). In the first embodiment, a voltage to be applied to a gate electrode of each transistor Tr2 (described later) can be controlled by controlling a voltage (equal to a light intensity correction value) that is to be applied to the capacitor CP connected to the transistor Tr2. As a result, the light emitting segments E emit light having the same intensity. The light intensity correction value is calculated on the basis of the measurement results of the intensities of light emitted by all the light emitting segments E before shipment of the line heads 29.

When a signal formed on the basis of the video data VD and received by any of the data terminals indicates a light emitting operation, a voltage is applied to the capacitor CP connected to the data terminal in order to ensure that the light emitting segment E connected to the data terminal emits light having a constant intensity. When a signal formed on the basis of the video data VD and received by any of the data terminals has a value indicating an operation for stopping emitting light, a voltage is applied to the capacitor CP connected to the data terminal in order to ensure that the transistor Tr2 connected to the capacitor CP prevents most of the drive current Ie from flowing into the light emitting segment E connected to the data terminal. The polarity of the voltage to be applied to each capacitor CP in order to prevent the light emitting segment E (connected to the capacitor CP) from emitting light is reversed depending on the polarity (p channel or n channel) of the transistor Tr2 connected to the capacitor CP. The video data VD is binary information only indicating the operation for emitting light or only indicating the operation for stopping emitting light. The video data VD may be multi-value data (to indicate tone levels). In this case, a voltage is applied to each capacitor CP on the basis of a tone level. Each light emission drive module 295 capable of performing the operations is described below in details.

Each of the light emission drive modules 295 has a first transistor Tr1 for each light emitting segment E. The first transistors Tr1 are the low-temperature polysilicon thin film transistors. Each first transistor Tr1 has source, drain and gate electrodes. The source electrodes of the first transistors Tr1 are connected to the respective data terminals. The drain electrodes of the first transistors Tr1 are connected to respective ends (first ends) of the capacitors CP. The other ends (second ends) of the capacitors CP included in each line head 29 are connected to a power supply VEL for the light emitting segments E included in the line head 29. The gate electrodes of the first transistors Tr1 are connected to the respective gate terminals W_gate. When an ON signal is input to any of the gate terminals W_gate, the first transistor Tr1 connected to the gate terminal W_gate is turned on. When an OFF signal is input to any of the gate terminals W_gate, the first transistor Tr1 connected to the gate terminal W_gate is turned off. Specifically, when the ON signal is input to the gate terminal W_gate, a voltage applied to the data terminal (connected to the gate terminal W_gate) is applied to the capacitor CP (connected to the gate terminal W_gate) so that electric charges are stored into the capacitor CP. When the OFF signal is input to the gate terminal W_gate, previously stored electric charges are held in the capacitor CP regardless of the value of a signal input, to the data terminal. This storage operation is repeated at a constant time interval. The quantity of electric charges stored in each capacitor CP does not substantially vary for a period of time between the storage operations, since each capacitor CP has a sufficient capacity.

The first transistor Tr1 for each light-emitting segment E is turned on to cause a current to flow through the first transistor Tr1 to the light emitting segment E so that the light emitting segment E emits light. The current flowing in each first transistor Tri is nearly constant due to a saturation property of the first transistor Tr1.

Each of the light emission drive modules 295 also includes the second transistor Tr2 for each light emitting segment E. The second transistors Tr2 are the low-temperature polysilicon thin film transistors. Each second transistor Tr2 has source and drain electrodes and the gate electrode. The drain electrodes of the second transistors Tr2 included in each line head 29 are connected to the power supply VEL for the light emitting segments E included in the line head 29. The source electrodes of the second transistors Tr2 are connected to the respective light emitting segments E through the respective lines We. The gate electrodes of the second transistors Tr2 are connected to the respective first ends of the capacitors CP. When any of the capacitors CP maintains a drive voltage, the second transistor Tr2 connected to the capacitor CP supplies a drive current Ie to the light emitting segment E connected to the second transistor Tr2 to cause the light emitting segment E to emit light. On the other hand, when the capacitor CP maintains a non-emission voltage, the second transistor Tr2 blocks the supply of the drive current Ie to the light emitting segment E to prevent the light emitting segment E from emitting light.

Each of the light emission drive modules 295 also has a third transistor Tr3 for each light emitting segment E. The third transistors Tr3 are the low-temperature polysilion thin film transistors. The third transistors Tr3 are connected to the respective second transistors Tr2 in parallel. Each third transistor Tr3 has source, drain and gate electrodes. The source electrodes of the third transistors Tr3 included in each line head 29 are connected to the power supply VEL for the light emitting segments E included in the line head 29. The drain electrodes of the third transistors Tr3 are connected to the respective electrical resistors R through the respective lines Wr. The gate electrodes of the third transistors Tr3 are connected to the respective first ends of the capacitors CP. The polarity of the third transistor Tr3 for each light emitting segment E is opposite to the polarity of the second transistor Tr2 for the light emitting segment E. Specifically, when any of the third transistors Tr3 is turned on, the second transistor Tr2 connected to the third transistor Tr3 is turned off. When any of the third transistors Tr3 is turned off, the second transistor Tr2 connected to the third transistor Tr3 is turned on. Thus, when any of the capacitors CP maintains the non-emission voltage, the third transistor Tr3 connected to the capacitor CP supplies a heater current Ih to the electrical resistor R to cause the electrical resistor R to generate heat. When any of the light emitting segments E is in a non-emitting state, the light emission drive module 295 connected to the light emitting segment E continuously supplies the heater current Ih to the electrical resistor R for the light emitting segment E. Then, the electrical resistor R continuously heats the light emitting segment E that is in the non-emitting state. When any of the capacitors CP maintains the drive voltage, the third transistor Tr3 connected to the capacitor CP blocks the supply of the heater current Ih to the electrical resistor R to cause the electrical resistor R to stop generating heat.

In the first embodiment, each of the light emission drive modules 295 supplies the drive current Ie to each light emitting segment E to cause the light emitting segment E to emit light. In addition, each light emission drive module 295 blocks the supply of the drive current Ie to each light emitting segment E to prevent the light emitting segment E from emitting light. If each light emission drive module 295 did not have such a configuration, heat generated by each light emitting segment E during the light emission would cause the problem described with reference to FIG. 5. In the first embodiment, however, when any of the light emitting segments E is in the non-emitting state, the light emission drive module 295 connected to the light emitting segment E supplies the heater current Ih to the electrical resistor R for the light emitting segment E. The heater current Ih causes the electrical resistor R to generate heat. Thus, the electrical resistor R heats the light emitting segment E that is in the non-emitting state. Therefore, each electrical resistor R is capable of reducing a difference between the temperature of the light emitting segment E (located adjacent to the electrical resistor R) in the non-emitting state and the temperature of the light emitting segment E in the light emitting state. In other words, each electrical resistor R is capable of reducing a variation in the temperature of the light emitting segment E located adjacent to the electrical resistor R regardless of the light emission state of the light emitting segment E. In the first embodiment, the electrical resistors R are capable of reducing a difference between or differences among the temperatures of the light emitting segments E.

In the first embodiment, during the time when each light emission drive module 295 blocks the supply of the drive current Ie to any of the light emitting segments E, the light emission drive module 295 continuously supplies the heater current Ih to the electrical resistor R for the light emitting segment E. During the time when the supply of the drive current Ie to the light emitting segment E is blocked or when the light emitting segment E is in the non-emitting state, the light emitting segment E is maintained at a high temperature. Each electrical resistor R is therefore capable of reliably reducing the difference between the temperature of the light emitting segment E (located adjacent to the electrical resistor R) in the light emitting state and the temperature of the light emitting segment E in the non-emitting state.

In the first embodiment, during the time when each light emission drive module 295 supplies the drive current Ie to any of the light emission devices E, the light emission drive module 295 continuously blocks the supply of the heater current Ih to the electrical resistor R for the light emitting segment E. Thus, each light emitting segment E generates heat during the light emission and is heated by the electrical resistor R for the light emitting segment E during the stop of the light emission. Each electrical resistor R is therefore capable of reducing the difference between the temperature of the light emitting segment (located adjacent to the electrical resistor R) in the light emitting state and the temperature of the light emitting segment in the non-emitting state.

Each light emission drive module 295 having the low-temperature polysilicon thin film transistors as described in the first embodiment is suitable to reduce a difference between the temperature of each light emitting segment (connected to the light emission drive module 295) in the light emitting state and the temperature of the light emitting segment in the non-emitting state. The low-temperature polysilicon thin film transistors have high electron mobility and are suitable to drive the organic electroluminescence elements (light emitting segments E). On the other hand, each of the low-temperature polysilicon thin film transistors has a temperature characteristic in which when the temperature of the low-temperature polysilicon thin film transistor is increased, the amount of the drive current Ie supplied to the light emitting segment E is increased. Thus, the intensity of light emitted by each light emitting segment E tends to be increased due to the increase in the temperature of each low-temperature polysilicon thin film transistor. It is, therefore, desirable to use the electrical resistors R in order to reduce a variation in the temperature of each light emitting segment E regardless of the light emission state of the light emitting segment E.

Second Embodiment

Figure 8:
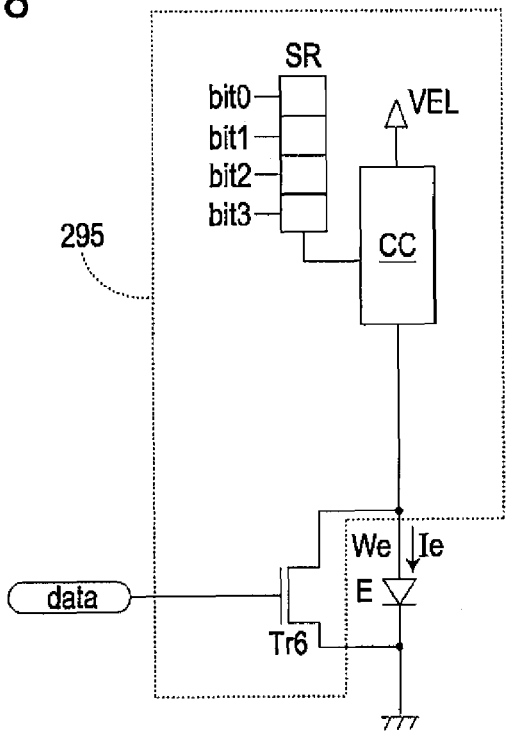
FIG. 8 is a diagram of the configuration of a circuit included in a light emission drive module according to a second embodiment of the invention.

FIG. 8 shows a circuit configuration of one of light emission drive modules 295 according to the second embodiment of the invention. Each light emission drive module 295 according to the second embodiment does not have the electrical resistors R, unlike the first embodiment. Each of the light emission drive modules 295 according to the second embodiment has a constant current circuit CC for each light emitting segment E. Each constant current circuit CC has an output terminal extending to the proximity of the light emitting segment E connected to the constant current circuit CC. In the second embodiment, each constant current circuit CC heats the light emitting segment E connected to the constant current circuit CC. The following describes a detail configuration of each light emission drive module 295 according to the second embodiment.

Each of the light emission drive modules 295 has a 4-bit shift register SR for each light emitting segment E. Each constant current circuit CC outputs a drive current Ie on the basis of a value latched by the 4-bit shift resister SR connected to the constant current circuit CC. The constant current circuits CC are connected to the respective light emitting segments E through respective lines We. A current signal transferred to each 4-bit shift register SR has a value (current value) predetermined on the basis of a characteristic of each light emitting segment E to ensure that the intensities (power) of light emitted by the light emitting segments E are constant. The current value corresponds to the light intensity correction value described in the first embodiment. If each 4-bit shift register SR does not have a sufficient resolution for a light intensity correction, each shift register SR may have more than 4 bits. The constant current circuits CC included in each line head 29 are connected to respective low-temperature polysilicon thin film transistors Tr6 (described later) included in the line head 29. The constant current circuits CC included in each line head 29 are provided on the head substrate 294 included in the line head 29, while the light emitting segments E included in the line head 29 are provided on the same head substrate 294.

The light emitting segments E are connected to the respective transistors Tr6 in parallel. The third transistors Tr6 are the low-temperature polysilicon thin film transistors. The third transistors Tr6 are connected to the respective constant current circuits CC. Each transistor Tr6 has source, drain and gate electrodes. The drain electrodes of the transistors Tr6 are connected to the respective lines We. The source electrode of each transistor Tr6 is connected to the ground potential. The gate electrodes of the transistors Tr6 are connected to the respective data terminals (indicated by "data" in FIG. 8). The head control module 400 applies, to each data terminal, a signal formed on the basis of the video data VD. During the time when a drive voltage is applied to any of the data terminals, the transistor Tr6 connected to the data terminal is turned off to supply the drive current Ie to the light emitting segment E and thereby cause the light emitting segment E to emit light. When a non-emission voltage is applied to any of the data terminals, the transistor Tr6 connected to the data terminal is turned on to cause most of the drive current Ie to flow into the transistor Tr6. Thus, the transistor Tr6 blocks the supply of the drive current Ie to the light emitting segment E to prevent the light emitting segment E from emitting light. The transistors Tr6 are different from the transistors Tr1 and only serve as switches. Each transistor Tr6 does not heat the light emitting segment E connected to the transistor. Tr6 in order to cause the light emitting segment E to emit light having a constant intensity. Each constant current circuit CC heats the light emitting segment E connected to the constant current circuit CC to cause the light emitting segment E to emit light having a constant intensity. The video data VD is a binary digital signal and of different type from that of the video data VD input to each data terminal described in the first embodiment.

When each light emitting segment E emits light, the light emitting segment E generates heat. When each light emitting segment E is in the non-emitting state, the transistor Tr6 that is connected to the light emitting segment E and turned on has low resistance. Thus, when any of the light emitting segments E is in the non-emitting state, the constant current circuit CC connected to the light emitting segment E generates heat. The constant current circuits CC are connected to the respective transistors Tr6. The constant current circuits CC included in each line head 29 are provided on the head substrate 294 included in the line head 29, while the light emitting segments E included in the line head 29 are provided on the same head substrate 294. Thus, the light emitting segments E in the non-emitting state are heated by the constant current circuits CC, while the light emitting segments E in the light emitting state generate heat. As a result, the temperatures of the light emitting segments E, or the temperatures of ambient environments of the light emitting segments E are constant or nearly constant. Thus, the intensities of light emitted by the light emitting segments E are nearly constant.

Third Embodiment

Figure 9:
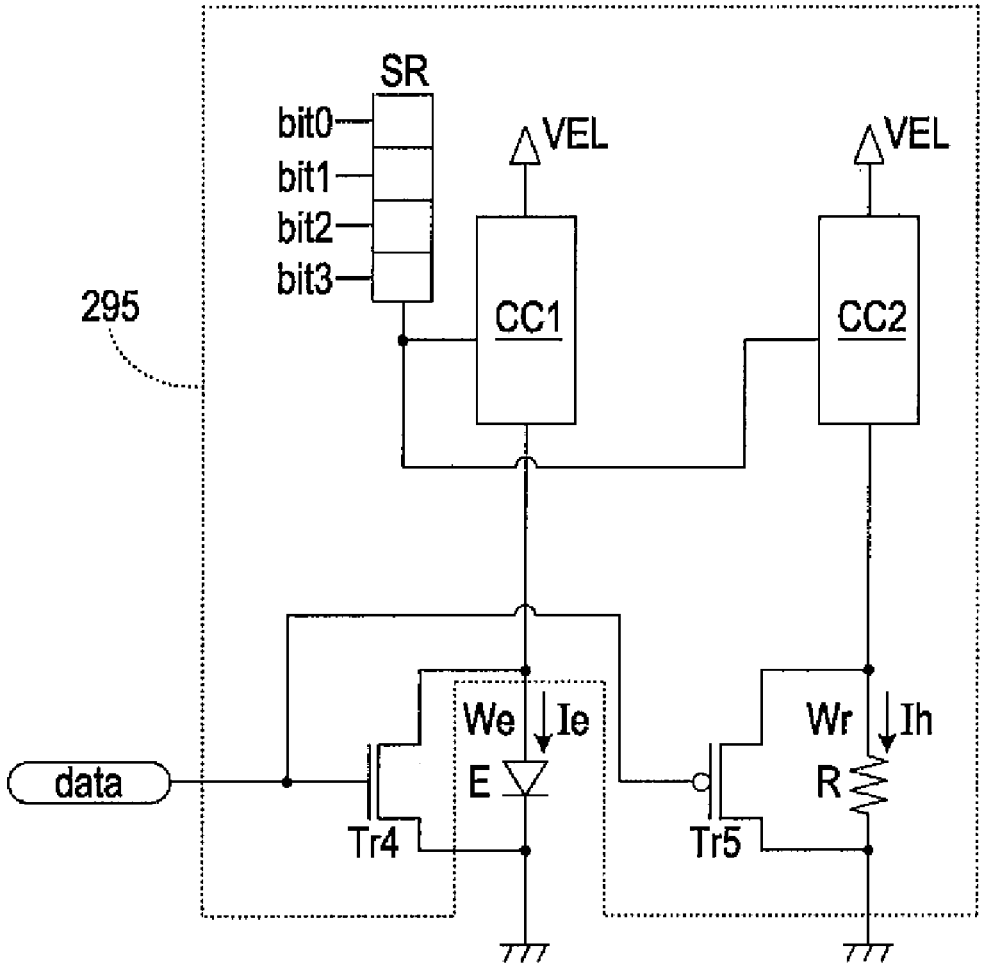
FIG. 9 is a diagram of the configuration of a circuit included in a light emission drive module according to a third embodiment of the invention.

FIG. 9 shows a circuit configuration of one of light emission drive modules 295 according to the third embodiment of the invention. Configurations other than each light emission drive module 295 according to the third embodiment are the same as those described in the first embodiment and are not described in the third embodiment. As shown in FIG. 9, each of the light emission drive modules 295 according to the third embodiment has a first constant current circuit CC1, a second constant current circuit CC2 and a 4-bit shift register, which are provided for each light emitting segment E. Each first constant current circuit CC1 outputs a drive current Ie on the basis of a value latched by the 4-bit shift register connected to the first constant current circuit CC1. The first constant current circuits CC1 are connected to the respective light emitting segments E through respective lines We.

The light emitting segments E are connected to respective fourth transistors Tr4 in parallel. Each fourth transistor Tr4 has source, drain and gate electrodes. The drain electrodes of the fourth transistors Tr4 are connected to the respective lines We. The source electrode of each fourth transistor Tr4 is connected to the ground potential. The gate electrodes of the fourth transistors Tr4 are connected to the respective data terminals (indicated by "data" in FIG. 9). The head control module 400 applies, to each data terminal, a signal formed on the basis of the video data VD. When a drive voltage is applied to any of the data terminals, the transistor Tr4 connected to the data terminal is turned off to supply the drive current Ie to the light emitting segment E and thereby cause the light emitting segment E to emit light. When a non-emission voltage is applied to any of the data terminals, the transistor Tr4 connected to the data terminal is turned on to cause most of the drive current Ie to flow into the transistor Tr4 and thereby block the supply of the drive current Ie to the light emitting segment E. Thus, the light emitting segment E stops emitting light.

As shown in FIG. 9, the first constant current circuit CC1 included in each light emission drive module 295 is separated from the second constant current circuit CC2 included in the light emission drive module 295. Each second constant current circuit CC2 outputs a heater current Ih on the basis of a value latched by the 4-bit shift register SR connected to the second current circuit CC2. The second constant current circuits CC2 are connected to the respective electrical resistors R through respective lines Wr. Each second constant current circuit CC2 has the same configuration as that of each first constant current circuit CC1. The heater current Ih output by each second constant current circuit CC2 has the same value as that of the drive current Ie output by the constant current circuit CC1 connected to the second constant current circuit CC2.

The electrical resistors R are connected to respective fifth transistors Tr5 in parallel. Each fifth transistor Tr5 has source, drain and gate electrodes. The source electrodes of the fifth transistors Tr5 are connected to the respective lines Wr. The drain electrode of each fifth transistor Tr5 is connected to the ground potential. The gate electrodes of the fifth transistors Tr5 are connected to the respective data terminals. The head control module 400 applies, to each data terminal, a signal formed on the basis of the video data VD. The polarity of each fourth transistor Tr4 is opposite to the polarity of the fifth transistor Tr5 connected to the fourth transistor Tr4. When the non-emission voltage is applied to any of the data terminals, the fifth transistor Tr5 connected to the data terminal is turned off to supply the heater current Ih to the electrical resistor R. The electrical resistor R generates heat due to the heater current Ih to continuously heat the light emitting segment E that is in the non-emitting state. When the drive voltage is applied to any of the data terminals, the fifth transistor Tr5 connected to the data terminal is turned on to cause most of the heater current Ih to flow into the fifth transistor Tr5 and thereby block the supply of the heater current Ih to the electrical resistor R. As a result, the electrical resistor R stops generating heat.

In the third embodiment, when any of the light emitting segments E is in the non-emitting state, the heater current Ih is supplied to the electrical resistor R for the light emitting segment E. Thus, each electrical resistor R according to the third embodiment is capable of reducing a variation in the temperature of the light emitting segment E connected to the electrical resistor R regardless of the light emission state of the light emitting segment E.

Each light emission drive module 295 according to the third embodiment is configured so that each constant current circuit CC2 outputs, to the electrical resistor R connected to the constant current circuit CC2, the heater current Ih having the same value as that of the drive current Ie output from the constant circuit current CC1 connected to the constant circuit current CC2. Each light emission drive module 295 according to the third embodiment is useful to reduce a difference between the amount of heat generated by each light emitting segment E having the drive current Ie supplied thereto and the amount of heat generated by the electrical resistor R (for the light emitting segment E) having the heater current Ih supplied thereto. Thus, each light emission drive module 295 according to the third embodiment is suitable to reduce a difference between the temperature of each light emitting segment in the light emitting state and the temperature of the light emitting segment in the non-emitting state.

Fourth Embodiment

Figure 10:
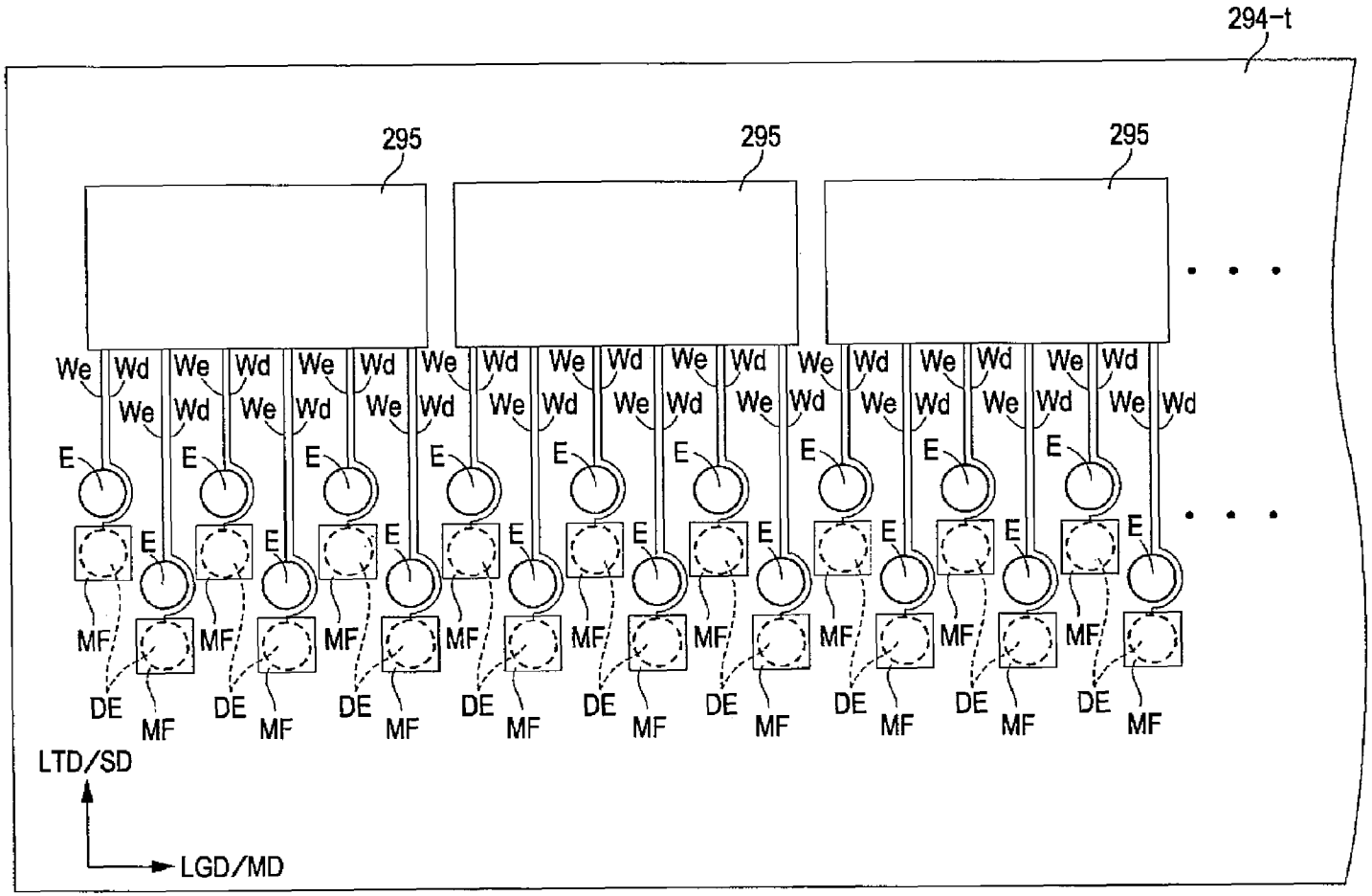
FIG. 10 is a plan view of a back surface of a head substrate according to a fourth embodiment of the invention.

FIG. 10 is a plan view of a back surface 294-*t* of one of head substrates 294 according to the fourth embodiment. In FIG. 10, the back surface 294-*t* of the head substrate 294 is viewed from the side of the front surface of the head substrate. In the fourth embodiment, each line head 29 has dummy elements DE instead of the electrical resistors R. The dummy elements DE are organic electroluminescence elements. This structure is different from the first and third embodiments. In the first and third embodiments, the electrical resistors R heat the light emitting segments E in the non-emitting state. In the fourth embodiment, the dummy elements DE heat the light emitting segments E in the non-emitting state. The dummy elements DE shown in FIG. 10 are not formed directly on the back surface 294-*t* of the head substrate 294 included in each line head 29. A metal film MF is placed between each dummy element DE and the back surface 294-*t* of the head substrate 294 included in each line head 29. Thus, the dummy elements DE cannot be viewed from the side of the back surface 294-*t* of the head substrate 294 included in each line head 29. Thus, the dummy elements DE are shown by broken lines in FIG. 10.

As shown in FIG. 10, the dummy elements DE are located adjacent to the respective light emitting segments E. Each light emission drive module 295 supplies a heater current Ih to each dummy element DE through a line Wd to cause the dummy element DE to generate heat. Each dummy element DE is the organic electroluminescence element having the same configuration as that of each light emitting segment E. Thus, the amount of heat generated by each light emitting segment E (that emits light when the drive current Ie is applied to the light emitting segment E) is equal to or substantially equal to the amount of heat generated by the dummy element DE (located adjacent to the light emitting segment E) due to the heater current Ih.

Since each dummy element DE is the organic electroluminescence element, the dummy element DE emits an optical beam from its light emitting surface when the heater current Ih is supplied to the dummy element DE. If the metal films MF were not provided, an optical beam emitted by each dummy element DE included in each line head 29 would be incident on the refractive index distribution type rod lens array 297 included in the line head 29, and an exposure failure would occur. That is, an unnecessary portion of the surface of the photosensitive drum 21 included in each line head 29 would be exposed to the optical beam emitted by the dummy elements DE included in the line head 29. In the fourth embodiment, however, the thin metal films MF are provided between the respective light emitting surfaces of the dummy elements DE and the back surface 294-*t* of the head substrate 294 included in line head 29. The metal films MF have a substantially square shape and cover the respective entire light emitting surfaces of the dummy elements DE. Each metal film MF included in each line head 29 prevents the optical beam emitted by the dummy element DE covered with the metal film MF from being incident on the refractive index distribution type rod lens array 297 included in the line head 29 and thereby prevents the aforementioned exposure failure.

In the fourth embodiment, when any of the light emitting segments E is in the non-emitting state, the light emission drive module 295 connected to the light emitting segment E supplies the heater current Ih to the dummy element DE for the light emitting segment E to cause the dummy element DE to generate heat. As a result, the dummy element DE heats the light emitting segment DE in the non-emitting state. Thus, each dummy element DE is capable of reducing a variation in the temperature of the light emitting segment E located adjacent to the dummy element DE regardless of the light emission state of the light emitting segment E, similarly to the first and third embodiments. A circuit that allows the dummy element DE to heat the light emitting segment E located adjacent to the dummy element DE can be replaced with the circuit (shown in FIG. 7 or 9) that does not include the electrical resistor R and includes the dummy element DE.

In the fourth embodiment, each dummy element DE heats the light emitting segment E (located adjacent to the dummy element DE) in the non-emitting state, and is the organic electroluminescence element having the same configuration of that of the light emitting segment E. Thus, each light emission drive module 295 is capable of easily reducing a difference between the amount of heat generated by each light emitting segment E having the drive current Ie supplied thereto and the amount of heat generated by each dummy element DE having the heater current Ih supplied thereto. In addition, each dummy element DE is capable of simply and reliably reducing a difference between the temperature of the light emitting segment E (located adjacent to the dummy element DE) in the light emitting state and the temperature of the light emitting segment E in the non-emitting state.

Miscellaneous

In the aforementioned embodiments, each line head 29 corresponds to an "exposure head" of the invention; each light emission drive module 295 to a "current supply controller" of the invention; each drive current Ie to a "first current" of the invention; each refractive index distribution type rod lens array 297 to an "optical system" of the invention; and each metal film MF to a "light shielding portion" of the invention. In the first and third embodiments, each electrical resistor R corresponds to an "electrical load" of the invention. In the second embodiment, each constant current circuit CC corresponds to the "electrical load" of the invention. In the fourth embodiment, each dummy element DE corresponds to the "electrical load" of the invention. In the first, third and fourth embodiments, each heater current Ih corresponds to a "second current" of the invention. In the second embodiment, the current (drive current Ie) output by each constant current circuit CC when the light emitting segment E connected to the constant current circuit CC is in the non-emitting state corresponds to the "second current" of the invention.

The invention is not limited to the above embodiments, and various changes may be made in the aforementioned embodiments without departing from the gist of the invention. In the aforementioned embodiments, the heating elements, which are the electrical resistors R, the constant current circuits CC or the dummy elements, are located adjacent to the respective light emitting segments E. Each heating element heats the light emitting segment E located adjacent to the heating element to reduce a variation in the temperature of the light emitting segment E regardless of the light emission state of the light emitting segment E. The heating elements (electrical resistors R, constant current circuits CC or dummy elements DE) can fulfill the respective heating functions even if the heating elements are not located adjacent to the respective light emitting segments E.

When a metal film is used on the side of a cathode of each organic electroluminescence element (light emitting segment E), heat may be transferred through the metal film and dispersed through another layer or the glass substrate (head substrate 294) to an ambient environment. A general line head has light emitting segments arranged at a pitch of approximately several tens of micrometers. In most cases, the temperatures of the light emitting segment that are included in the general line head and arranged at a pitch of approximately several tens of micrometers do not vary due to a difference between or differences among the amounts of heat generated by the light emitting segments. When the light emitting segments included in the general line head are arranged at a pitch of one millimeter or more, the temperatures of the light emitting segments may vary. Therefore, the heating elements (electrical resistors R, constant current circuits CC or dummy elements DE) that are arranged adjacent to the respective light emitting segments E with distances of approximately several tens of micrometers therebetween will suffice to heat the respective light emitting segments E. Since the light emitting segments E are arranged adjacent to each other on the basis of a writing density (or resolution), it may be difficult that the heating elements (electrical resistors R, constant current circuits CC or dummy elements DE) are arranged adjacent to the light emitting segments E. In such a case, the heating elements (R, CC or DE) may be arranged near the respective light emitting segments E with certain distances therebetween.

In the first and third embodiments, the electrical resistors R have load characteristics equivalent or substantially equivalent to those of the light emitting segments E. The load characteristic of each electrical resistor R is not limited to this. Any type of element capable of heating the light emitting segment E in the non-emitting state can be used to achieve the effect of the invention.

In the first and third embodiments, the electrical resistors R are provided for the respective light emitting segments E. However, the number of the electrical resistors R and the number of the light emitting segments E are not limited to this relationship. A plurality of the electrical resistors R may be provided for each light emitting segment E.

In the fourth embodiment, each dummy element DE has the same configuration as that of each light emitting segment E. However, each dummy element DE may have dimensions different from those of each light emitting segment E.

In the embodiments, when the supply of the drive current Ie to any of the light emitting segments E is blocked, or when the light emission device E is in the non-emitting state, the heater current Ih is continuously supplied to the electrical resistor R for the light emitting segment E. Each light emission drive module 295 may be configured so that during a part of the time period when any of the light emitting segments E connected to the light emission drive module 295 is in the non-emitting state, the heater current Ih is supplied to the electrical resistor R for the light emitting segment E.

In the embodiments, during the time when any of the light emission drive modules 295 supplies the drive current Ih to any of the light emitting segment E connected to the light emission drive module 295 or when the light emitting segment E is in the light emitting state, the light emission drive module 295 blocks the supply of the heater current Ih to the electrical resistor R for the light emitting segment E. Each light emission drive module 295, however, may not have this configuration.

In the embodiments, the light emitting segments E and the heating elements (R, CC or DE) generate heat. Thus, the total amount of heat generated by each line head 29 tends to be increased. Thus, even when the temperatures of the plurality of light emitting segments E are equal to each other, the temperatures of the light emitting segments E may be increased. Specifically, when a printing duty is in a general range of 5% to 20%, the total amount of heat generated by the light emitting segments E and the heating elements (R, CC or DE) is larger by approximately 5 to 20 times than the total amount of heat generated by the light emitting segments E. To avoid this, each line head 29 may have a cooling structure (such as a fan) to cool the line head 29. Alternatively, each line head 29 may detect the temperature of an atmosphere surrounding the line head 29 and control the drive voltage to be supplied to each data terminal on the basis of the detected temperature. In addition, the cooling structure of each line head 29 may include a controller that controls the drive voltage to be supplied to each data terminal.

As described above, the intensities of light emitted by the light emitting segments E may vary even when the drive currents Ie having the same value are supplied to the light emitting segments E. In this case, the drive current Ie may be adjusted for each light emitting segment E. For example, when the circuits shown in FIG. 7 are used, the drive voltage applied or to be applied to each data terminal may be adjusted for each light emitting segment E. When the circuits shown in FIG. 9 are used, a value set in the shift register SR may be adjusted for each light emitting segment E.

In the embodiments, the plurality of light emitting segments E included in each line head 29 are arranged in the two rows in the staggered pattern. The arrangement of the light emitting segments E is not limited to this. The plurality of light emitting segments E may be arranged in three or more rows in a staggered pattern. Alternatively, the plurality of light emitting segments E may be arranged in a single row.

The configuration of each line head 29 is not limited to the aforementioned configurations. Each line head 29 may be replaced with a line head described in JP-A-2008-036937 or a line head described in JP-A-2008-36939. Each of the line heads described in JP-A-2008-036937 and JP-A-2008-36939 has multiple groups of light emitting segments that are two-dimensionally arranged, and the light emitting segments of each group are arranged in a staggered pattern.

The entire disclosure of Japanese Patent Applications No. 2009-050183, filed on Mar. 4, 2009 is expressly incorporated by reference herein.

What is claimed is:

1. An exposure head comprising:

a light emitting segment that emits light;

an electrical load that is electrically connected to a circuit in which a current to be supplied to the light emitting segment flows; and a current supply controller that supplies a first current to the light emitting segment to cause the light emitting segment to emit light and supplies a second current to the electrical load during the time when the current supply controller blocks the supply of the first current to the light emitting segment.

2. The exposure head according to claim 1, wherein the current supply controller continuously supplies the second current to the electrical load during the time when the current supply controller blocks the supply of the first current to the light emitting segment.

3. The exposure head according to claim 1, wherein the current supply controller continuously blocks the supply of the second current to the electrical load during the time when the current supply controller supplies the first current to the light emitting segment.

4. The exposure head according to claim 1, wherein the second current has the same value as the first current.

5. The exposure head according to claim 1, wherein the light emitting segment and the electrical load are organic electroluminescence elements.

6. The exposure head according to claim 5, further comprising:

an optical system that focuses the light emitted by the light emitting segment; and a light shielding portion that prevents light emitted by the electrical load from being incident on the optical system.

7. An image forming apparatus comprising:

a latent image carrier on which a latent image is formed;

an exposure head having a light emitting segment that emits light, an electrical load that is electrically connected to a circuit in which a current to be supplied to the light emitting segment flows, and an optical system that focuses the light emitted by the light emitting segment onto the latent image carrier; and a current supply controller that supplies a first current to the light emitting segment to cause the light emitting segment to emit light and supplies a second current to the electrical load during the time when the current supply controller blocks the supply of the first current to the light emitting segment.

8. An image forming method comprising:

supplying a first current to a light emitting segment to cause the light emitting segment to emit light and exposing a latent carrier to the light emitted by the light emitting segment; and blocking the supply of the first current to the light emitting segment and supplying a second current to an electrical load that is electrically connected to a circuit in which the first current to be supplied to the light emitting segment flows.

* * * * *